United States Patent [19]

Mitchell et al.

[11] Patent Number: 4,521,922

[45] Date of Patent: Jun. 11, 1985

[54] EVAPORATIVE NON-DRIPPING SWEAT BAND

[75] Inventors: Albert W. Mitchell, Houston; Richard W. Miller, Sugar Land, both of Tex.

[73] Assignee: Wet Wraps, Inc., Houston, Tex.

[21] Appl. No.: 463,396

[22] Filed: Feb. 3, 1983

[51] Int. Cl.[3] ..... A42B 1/00

[52] U.S. Cl. ..... 2/171; 2/170; 2/DIG. 11

[58] Field of Search ..... 2/181, 171, 207, DIG. 11, 2/195, 198, 200, 181.2, 181.4, 181.6, 181.8, 170, 182.3

[56] References Cited

U.S. PATENT DOCUMENTS

| | | | |
|---|---|---|---|
| 1,084,596 | 1/1914 | Alexander | 2/181 |
| 1,633,586 | 6/1927 | Hunter | 2/171 |
| 2,377,933 | 6/1945 | Glass | 2/181 |
| 2,709,261 | 5/1955 | Kalensky | 2/198 |
| 3,027,564 | 4/1962 | Wagenfeld | 2/181 |
| 3,089,146 | 5/1963 | Sterne | 2/181 |
| 3,381,309 | 5/1968 | Cohen | 2/207 |
| 4,130,902 | 12/1978 | Mackenroth et al. | 2/182.3 X |
| 4,277,847 | 7/1981 | Florio | 2/171 X |

FOREIGN PATENT DOCUMENTS

| | | | |
|---|---|---|---|
| 0513032 | 5/1955 | Canada | 2/171 |

*Primary Examiner*—Peter Nerbun

*Attorney, Agent, or Firm*—Vaden, Eickenroht, Thompson & Jamison

[57] ABSTRACT

A non-dripping sweat band that encircles the users head between the hairline and eyebrows with loose ends secured by quick release fasteners behind the user's head. The ban has a tube-like body formed by a porous cloth cover (e.g., cotton) which is bias cut to form panels on each side of a lengthwise fold. A strip of porous, thick batting material (e.g., Dacron polyester pad) is sewn lengthwise to the cloth cover and also to the edges of the panels. The assembly is turned inside out whereby the cloth cover is exterior of the tubular batting material which extends between the temples. Velcro strips can be attached to the loose ends of the body. The band is pulled into a flat belt-like band across the user's brow so as to wick sweat sideways away from the eyes and towards the sideburns where excess perspiration can be released. The band resumes a tubular configuration upon relaxation of the tensioning forces to promote quick drying after washing. Excess perspiration is wicked from the brow and released at the sideburn area of the user's head.

10 Claims, 6 Drawing Figures

FIG.1
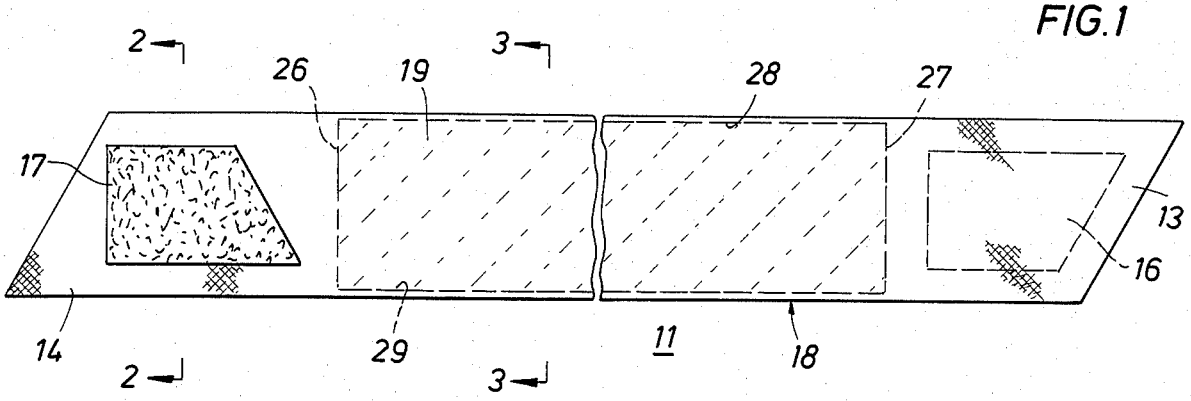
FIG.2
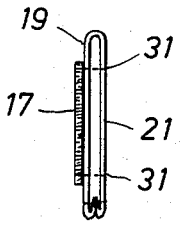
FIG.3
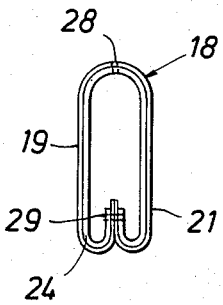
FIG.4
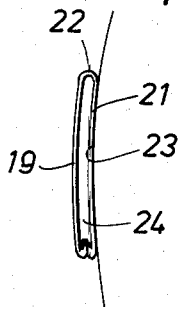
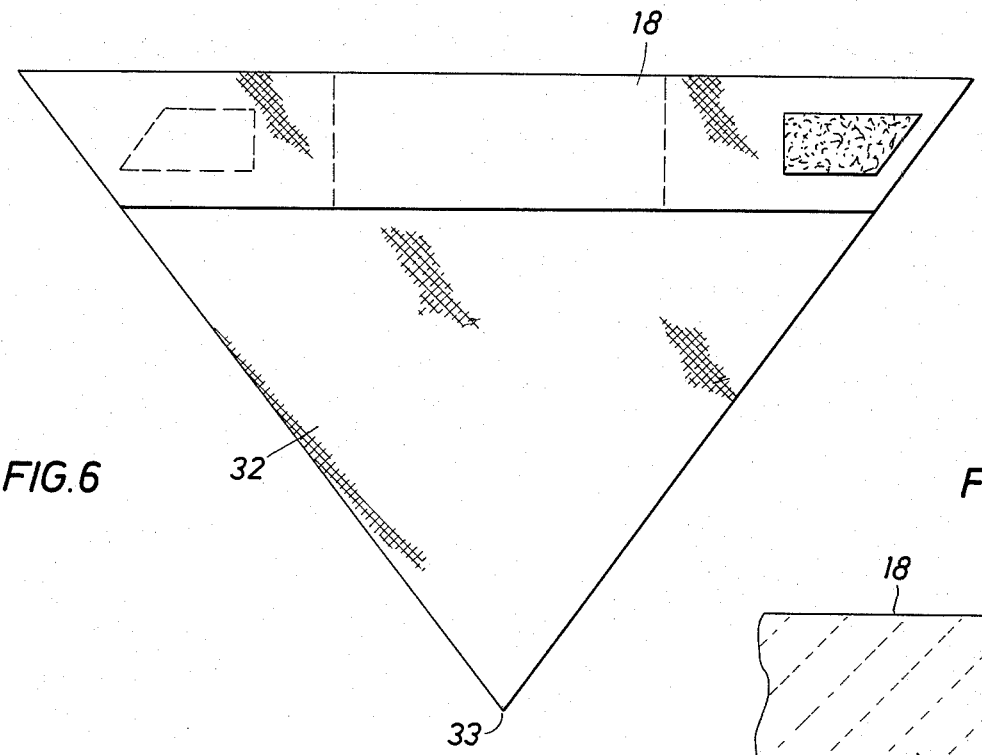
FIG.6
FIG.5
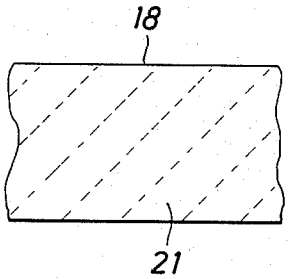

EVAPORATIVE NON-DRIPPING SWEAT BAND

BACKGROUND OF THE INVENTION

1. Field of the Invention

This invention relates to apparel and it more particularly relates to sweat bands.

2. Background of the Invention

Sweat bands have been worn on the human head to keep perspiration from the wearer's eyes and also as a decorative head piece. The sweat bands can be very simple in use, such as a cotton bandana rolled lengthwise and tied rearwardly with a knot about the head. Scarfs forming head coverings with a tubular band across the brow have also been used for the same purposes. More sophisticated sweat bands have used sponge rubber or synthetic foam as the material to absorb the perspiration. However, these materials reached a saturated condition where perspiration loading exceeded evaporation, and then excess perspiration would be released to flood the user's eyes usually when a downward head movement occurred. Although the sweat band could be washed, it usually had to be thoroughly dried to restore its function.

The present invention is a unique sweat band that very effectively evaporates perspiration but no excess perspiration can accumulate therein to be inadvertently released into the user's eyes. Such excess perspiration is carried laterally by the band to the temples and then can flow downwardly along the sideburns and away from the eyes.

SUMMARY OF THE INVENTION

In accordance with this invention, there is provided a head encircling, non-dripping sweat band. The band has an elongated tubular body adapted to be worn between the hairline and eyebrows and secured by gripping means on a pair of loose ends rearwardly of the user's head. The body has a porous cloth cover folded lengthwise and being cut across its grain to provide bias panels each side of the fold. A layer of porous thick batting material having a width of the panels is enclosed within the cover. Lengthwise stitching of the batting material at the fold and through the edges of the panels secures the batting material to the cover. The batting material extends lengthwise across the users brow and to his sideburns. The body is pulled into a flat belt-like band across the users brow but resumes a tubular configuration upon release of tensioning forces. As a result, perspiration from the brow is wicked by the batting material for evaporation through the cloth, and any excess perspiration will travel to the ends of the batting material for release into the users sideburns.

DESCRIPTION OF THE DRAWINGS

FIG. 1 is an elevation of a preferred embodiment of the present sweat band;

FIGS. 2, 3 and 4 are cross sections taken along lines 2—2, 3—3 and 4—4 of FIG. 1;

FIG. 5 is a partial elevation of the reverse side of the sweat band shown in FIG. 1, and FIG. 6 is another embodiment of the sweat band with a head covering, triangular bandana piece.

DESCRIPTION OF PREFERRED EMBODIMENT

Referring to FIGS. 1–5, there is shown an embodiment of the present sweat band 11 which is strip like with a brow engaging center portion 12 and loose ends 13 and 14 by which it can be secured about the user's head. The band 11 may have any width and length within reason, as for example, a width of about 2 inches and a length of about 33 inches. The ends 13 and 14 are provided with releaseable means so that the band 11 can be secured about the users head and removed therefrom, as is desired. These means are preferably quick release fasteners such as provided by strips 16 and 17 sewn to opposite faces of the ends 13 and 14. The strip 16 can carry hook-like projections and the strip 17 can carry hairsute material such as available in Velcro and Velstik fastener strips.

The band 11 includes a porous cloth cover 18, preferably of a cotton/polyester blend fabric. The cover 18 is cut across the fabric grain to provide bias panels 19 and 21 to each side of a lengthwise fold 22. The bias grains are shown in chain lines in FIGS. 1 and 5. The bias grain in the panels insure that the band 11 is pulled into a flat belt-like configuration across the brow 23 of the user, as best seen in FIG. 4. This belt-like form promotes a high rate of evaporation of perspiration. As a result, there is no tendency of the band to "roll" on the users brow, which rolling problem leads to discomfort and "wringing out" of perspiration into his eyes.

A layer 24 of porous, thick batting material is enclosed within the cover 18. Preferably, the material is Dacron polyester quilting pad about one-fourth inch in thickness when in its relaxed state. The material is springy or resilient and relatively free of bacteria degredation but provides a good "wicking" action to perspiration. By "wicking action" is meant the ability of perspiration to be carried uniformly throughout the batting material, both laterally to the cover 18 and longitudinally towards the ends 13 and 14. Thus, the layer 24 promotes evaporation of perspiration, and the carrying of any excess perspiration towards the ends 13 and 14. For this purpose, the layer 24 should have a length between boundaries 26 and 27 to extend across the brow 23 and to the users sideburns or temples where there is a layer of hair to provide an escape avenue to the excess perspiration. In no usual event, will any excess perspiration be released from the layer 24 so as to travel into the user's eyes.

The cover 18 and layer 24 are assembled into a tubular form by any suitable fabrication but preferably sewn construction is used. The cover 18 is placed with the panels 19 and 21 face down and the layer 24 (of equal width) is placed on top of these panels. A lengthwise stitching 28 is made along or adjacent the fold 22. Now, the panels and layer 24 are doubled along fold 22 with the layer 24 being on the outside. Also, lengthwise stitching 29 is made through the aligned edges of the panels and layer 24.

It is noted that the stitching 28 and 29 does not extend to the ends 13 and 14, but merely the length of the layer 24 between its boundaries 26 and 27. Now, the cover 18 and layer 24 are turned inside out where the cover 18 is exterior of the layer 24 but both elements have a tubular configuration when in the released state due to the resilient properties of the batting material. However, the band will flatten into a belt-like configuration on the brow 23 when tension is applied at the ends 13 and 14. Thus, good surface-to-surface contact is made by the band to the brow.

This resiliency to assume a tubular configuration is a great asset when the band is removed and washed. It will quickly air dry because of the tube like relaxed state shape of the band as seen in FIG. 3. Alternatively, the belt-like shape as seen in FIG. 4 promotes the wicking action to promote evaporation of sweat through the cover but yet conduct excess perspiration to the users temples so that none of it can reach the user's eyes.

The strips 16 and 17 can be sewn to the band 11 in final fabrication, and the stitching 31 can pass through both panels 19 and 21 to reinforce the ends 13 and 14, as seen in FIG. 2.

The present sweat band 11 can be arranged to also provide a hair covering for the users head, as can be seen in FIG. 6. The band 11 is provided with a triangular cloth piece 32 that extends a sufficient lateral distance that its end 33 can be tucked behind the ends 13 and 14 fastened behind the user's head in a bandana type of head apparel. The remainder of the band 11 can be the same as in FIGS. 1–5.

From the foregoing, there has been provided a novel sweat band that provides evaporation of perspiration but avoids dripping any excess perspiration into the users eyes. It will be apparent that certain changes and alterations in the present invention can be made without departing from the spirit of this invention. These changes are contemplated by and are within the scope of the appended claims which define the invention. Additionally, the present description is intended to be taken as an illustration of this invention.

What is claimed is:

1. A head-encircling non-dripping sweat band comprising:

(a) an elongated tubular body adapted to be placed between the hairline and eyebrows of the user and secured by a pair of loose ends rearwardly of the users head;

(b) gripping means for releaseably securing said loose ends together;

(c) said body formed by a porous cloth cover folded lengthwise and being cut across its grain to provide bias panels to each side of the lengthwise fold;

(d) a layer of porous thick resilient batting material extending over a portion of the width of the panels and being enclosed within said porous cloth cover, said layer is secured by lengthwise stitching adjacent the fold in said cloth cover and by lengthwise stitching along its edges and to edges along said panels, and (e) said batting material in said body extending in length across the user's brow and to his temples so that perspiration from the brow is wicked by said batting material for evaporation through said porous cloth, and any excess perspiration will travel to the ends of said batting material for release into the users sideburns; said body during use being pulled into a substantially flat belt-like band across the users brow but resuming its original tubular configuration upon release of tensioning force.

2. The sweat band of claim 1 wherein said gripping means comprises a strip with hook like projections secured at one loose end and a strip with hairsute material secured at the other loose end of said body.

3. The sweat band of claim 1 wherein said body carries a triangle panel of cloth extending from one edge thereof and of a size to be extended over the users head and tucked beneath said loose ends in the nature of a bandana.

4. The sweat band of claim 2 wherein said strips are selected from Velcro and Velstik band materials.

5. The sweat band of claim 1 wherein said batting material is polyester synthetic fabric.

6. The sweat band of claim 5 wherein said batting material is Dacron brand fabric.

7. The sweat band of claim 1 wherein said batting material is substantially the same width as the panels of said cloth cover, and the edges of said batting material and said cloth cover are sewn together lengthwise with said batting material facing outwardly and then said batting material and cloth cover are turned inside out so that the cloth cover is exterior thereof.

8. The sweat band of claim 7 wherein said strips with hook-like projections and hairsute material are sewn to the loose ends of said sweat band after said cloth cover is turned exteriorly of said batting material.

9. The sweat band of claim 1 wherein said cloth cover is cotton fabric.

10. The sweat band of claim 1 wherein said cloth cover is a cotton/polyester blend fabric.

* * * * *